US005676299A

United States Patent [19]

Yoshie et al.

[11] Patent Number: 5,676,299

[45] Date of Patent: Oct. 14, 1997

[54] STAPLE REFILL CARTRIDGE FOR ELECTRIC STAPLER

[75] Inventors: Toru Yoshie; Kazuo Takahashi, both of Tokyo, Japan

[73] Assignee: Max Co., Ltd., Tokyo, Japan

[21] Appl. No.: 527,723

[22] Filed: Sep. 13, 1995

[30] Foreign Application Priority Data

Sep. 29, 1994 [JP] Japan ..... 6-259111

[51] Int. Cl.[6] ..... B27F 7/21

[52] U.S. Cl. ..... 227/120; 227/131

[58] Field of Search ..... 227/120, 136, 227/131; 206/340

[56] References Cited

U.S. PATENT DOCUMENTS

| | | | |
|---|---|---|---|
| 2,132,604 | 10/1938 | Chase | 206/44 |
| 2,136,797 | 11/1938 | Lee | 206/44 |
| 4,623,082 | 11/1986 | Kurosawa | 227/7 |
| 4,993,616 | 2/1991 | Yoshie et al. | 227/120 |
| 5,454,503 | 10/1995 | Udagawa et al. | 227/120 |
| 5,501,387 | 3/1996 | Yoshie | 227/120 |

FOREIGN PATENT DOCUMENTS

| | | |
|---|---|---|
| 0 608 756 | 8/1994 | European Pat. Off. . |
| 0 637 487 | 2/1995 | European Pat. Off. . |
| 9320977 | 10/1993 | WIPO . |

*Primary Examiner*—Scott A. Smith

*Attorney, Agent, or Firm*—Cushman Darby & Cushman IP Group of Pillsbury Madison & Sutro LLP

[57] ABSTRACT

A staple refill cartridge for an electric stapler via a cartridge is releasably attached to the electric stapler and made of paper for replenishing sheet staples formed by uniting straight staples together in sheet form, and the refill cartridge includes: two lateral wall portions; a rear wall portion formed between the two lateral wall portions into a continuous body; and an overlapping piece having substantially the same size as the rear wall portion, the overlapping piece being overlapped inside the rear wall portion, wherein a corner portion is formed by each of the two lateral wall portions and each of both lateral ends of the overlapping piece.

7 Claims, 5 Drawing Sheets

STAPLE REFILL CARTRIDGE FOR ELECTRIC STAPLER

BACKGROUND OF THE INVENTION

1. Field of the Invention

The invention relates to a refill cartridge which is designed to be releasably arranged to an electric stapler via a cartridge for replenishing consumed staples.

2. Description of the Related Art

Conventionally, staples for electric staplers are supplied from a synthetic resin-formed cartridge in which the staples are contained. When the staples have been used up, the cartridge is replaced with a new one. As a result, the cartridge whose staples have been consumed is destined to be scrapped, addressing an environmental problem. To overcome this problem, a new type of cartridge has been proposed. A refill cartridge that is refillable to the cartridge contains staples so that the cartridge can no longer be wasted every time the whole staples have been consumed.

By the way, the staples loaded into the refill cartridge are such that straight staples are united together in sheet from. A plurality of such sheets are layered one upon another.

Therefore, a refill cartridge that is formed by folding a sheet of paper includes a corner portion P1 that is projected as shown in FIG. 7(*a*) or a corner portion P2 that is rounded as shown in FIG. 7(*b*), which corners being the folds between the lateral wall portion and the rear wall portion. As a result, a corner portion 20*a* of a sheet staple 20 is caught up by such corner portion of the refill cartridge so that the sheet staple 20 cannot move downward smoothly, which in turn imposed the problem of blocking staple forwarding or breaking the sheet staple.

SUMMARY OF THE INVENTION

The invention has been made to overcome the aforementioned problem. The object of the invention is, therefore, to provide a staple refill cartridge for an electric stapler which allows sheet staples within the refill cartridge to move reliably and smoothly at all times even if the refill cartridge is formed by folding a sheet of paper.

To achieve the above object, the invention provides a staple refill cartridge for an electric stapler is releasably attached to the electric stapler via a cartridge and made of paper for replenishing sheet staples formed by uniting straight staples together in sheet form, and the refill cartridge includes: two lateral wall portions; a rear wall portion formed between the two lateral wall portions into a continuous body; and an overlapping piece having substantially the same size as the rear wall portion, the overlapping piece being overlapped inside the rear wall portion, wherein a corner portion is formed by each of the two lateral wall portions and each of both lateral ends of the overlapping piece.

According to the invention, a total of three wall portions, i.e., both lateral wall portions and the rear wall portion, are made continuous to each other when the original sheet is shaped by folding. However, since the overlapping piece having substantially the same size as the rear wall portion is overlapped inside the rear wall portion in the middle, the rear wall portion is doubled. Therefore, the corner of a sheet staple loaded into the refill cartridge corresponds to the corner portion formed between the inside rear wall portion that is formed by the overlapping piece and each lateral wall portion. However, this corner portion, not being continuous, is neither projected nor rounded. Hence, when the sheet staple is loaded into the refill cartridge, the corners of the sheet staple are not caught up by the corner portions of the refill cartridge, allowing the sheet staples to move downward smoothly as well as reliably at all times.

DETAILED DESCRIPTION OF THE PREFERRED EMBODIMENTS

Figure 1:
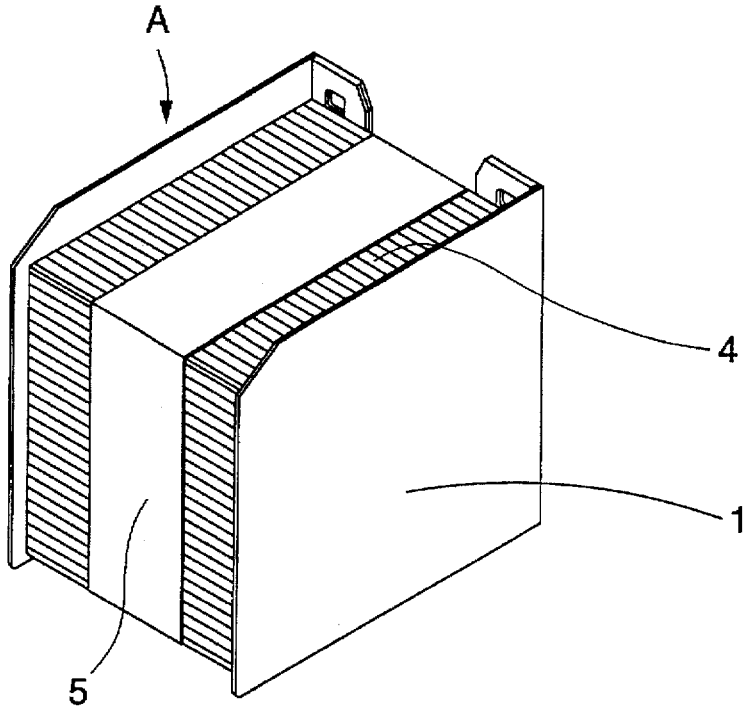
FIGS. 1(*a*) and 1(*b*) are perspective views showing a refill cartridge of the invention as viewed from top and bottom.
Figure 1:
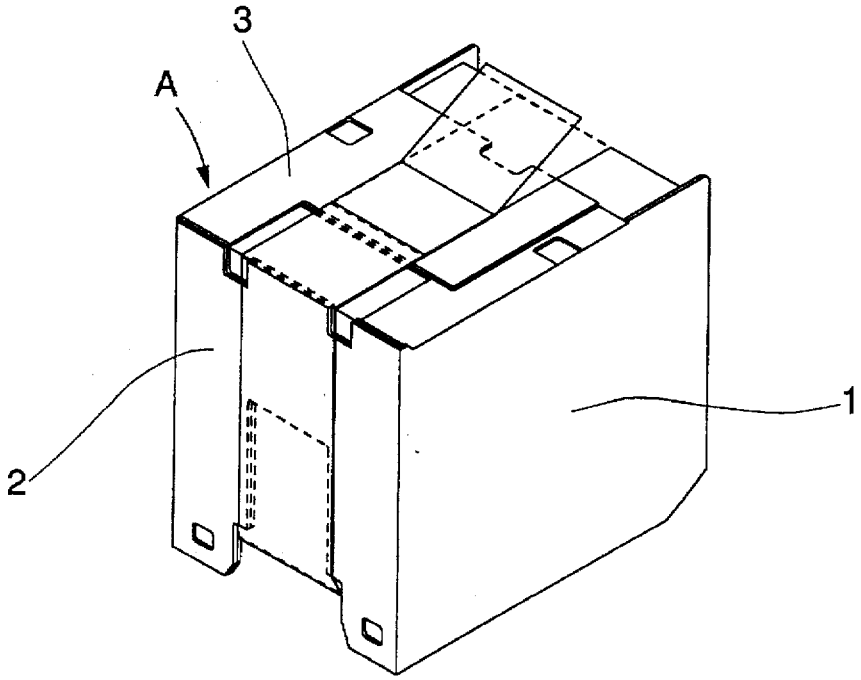

FIGS. 1(*a*) and 1(*b*) are perspective views showing a refill cartridge of the invention as viewed in different directions. This refill cartridge is constructed of both lateral wall portions 1, a rear wall portion 2, and a bottom wall portion 3, and is designed to refill sheet staples 4 while releasably attached to a cartridge. Each sheet staple 4 is formed by uniting untwisted, straight staples together in sheet form, and is accommodated in the refill cartridge in layers. A binding tape 5 is wound integrally around the sheet staples 4 and the refill cartridge A. It may be noted that the binding tape 5 is removed once the sheet staples 4 have been attached to the cartridge described later.

Figure 2:
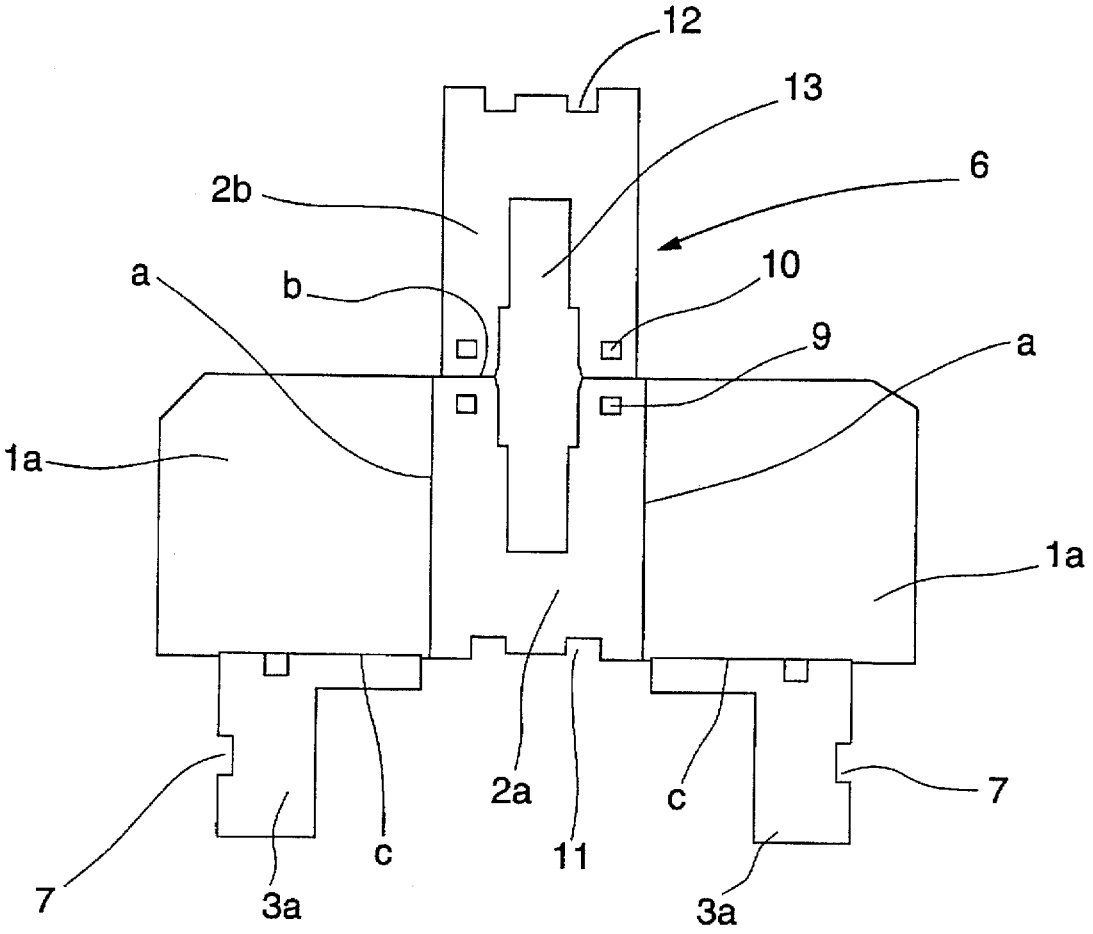
FIG. 2 is a development of the refill cartridge.

The refill cartridge is formed by folding an original sheet 6 that has such a shape as shown in FIG. 2 in developed form. More specifically, the original sheet 6 for the refill cartridge includes, as shown in FIG. 2, a rear wall piece 2*a* that is in the middle, lateral wall pieces 10*a* continuous to the rear wall piece 2*a* through folding lines a, an overlapping piece 2*b* continuous to the rear wall piece 2*a* through a folding line b, and bottom pieces 3*a* continuous to the lateral wall pieces 1*a* through folding lines c. The rear wall piece 2*a* and the overlapping piece 2*b* are formed so as to be substantially symmetrical with respect to the folding line b. While the width of the overlapping piece 2*b* is set to substantially the same value as the width of the rear wall piece 2*a*, it is preferred to make the width of the overlapping piece 2*b* slightly smaller as shown in FIG. 2.

It may be noted that a notch 7 of each bottom piece 3*a* is provided for positioning at the time of bonding the pieces together; holes 9 and 10 that are symmetrical with respect to the line b in both the rear wall piece 2*a* and the overlapping piece 2*b* are provided to retain the refill cartridge in retaining portions (not shown) formed on the refill cartridge accommodating section of the cartridge; and notches 11 and 12 are provided to allow a staple forwarding member (not shown) to escape therethrough, the notches 11 of the rear wall piece 2*a* being formed slightly smaller than the notches 12 of the overlapping piece 2*b*. In addition, a middle opening 13 that is symmetrical with respect to the line b in the rear wall piece 2*a* and the overlapping piece 2*b* is provided for detection with a remaining sheet staple detecting device arranged in a cartridge accommodating section of a magazine.

It is preferred to make perforations along the folding lines so that correct folding can be achieved.

Figure 3:
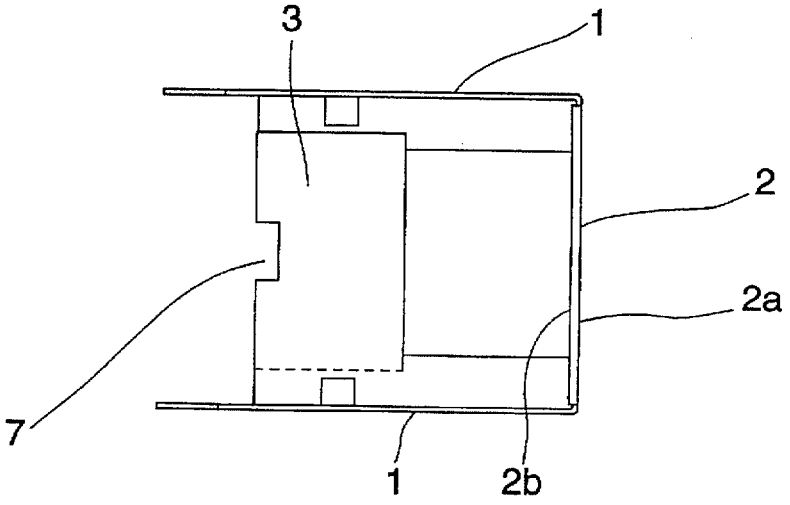
FIG. 3 is a plan view of the refill cartridge.
Figure 4:
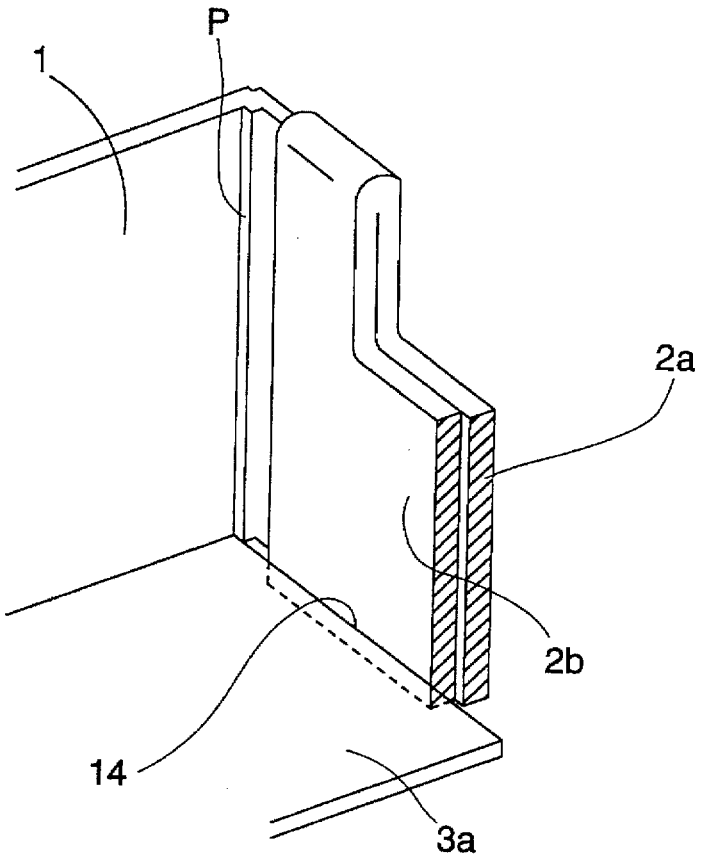
FIG. 4 is an enlarged perspective view of a corner portion of the refill cartridge.

For forming the refill cartridge out of the original sheet 6 in developed form, the following steps are taken. The lateral wall pieces 1*a* and the bottom pieces 3*a* are folded along the folding lines a, c inward, respectively, so as to be at right angles to each other; the bottom pieces 3*a* are overlapped one upon the other and bonded to each other so that the notches 7 coincide; and the overlapping piece 2*b* is folded 180° inward from the folding line b so as to be overlapped on the rear wall piece 2*a* (see FIGS. 3 and 4). It may be noted that the rear wall portion 2 is constructed of the rear wall piece 2*b* and the overlapping piece 2*b*. Further, it is proposed that the lower end of the overlapping piece 2*b* be inserted into a gap 14 formed between the lower end of the lateral wall portions 1 constructed of both lateral wall pieces 1*a* and the rear end of the bottom wall portion 3 constructed of the bottom piece 3*a*.

Figure 5:
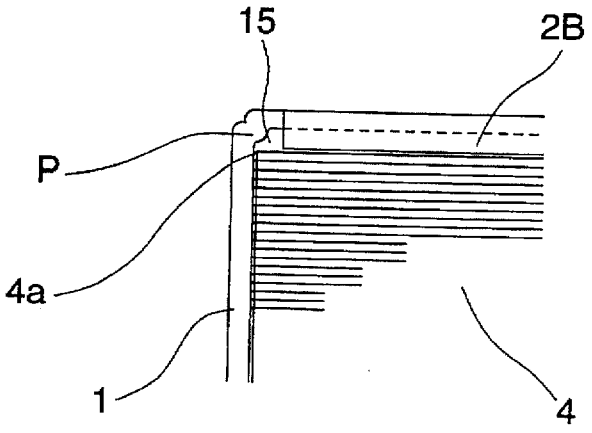
FIG. 5 is an enlarged view of a corner portion of the refill cartridge.

As described above, the refill cartridge is thus formed by folding and bonding the original sheet 6, so that a total of three wall portions, i.e., both lateral wall portions 1 and the rear wall portion 2 are formed into a continuous body. However, since the overlapping piece 2*b* that has substantially the same size as the rear wall portion 2 is overlapped in the inner side of the rear wall portion 2 in the middle, the rear wall portion 2 is doubled, forming a corner portion between each lateral wall piece 1*a* and each of lateral ends of the overlapping piece 2*b* inside a corner portion P formed by a fold between each lateral wall piece 1*a* and the rear wall piece 2*a*. Further, as shown in FIG. 5, a gap 15, although very small, is formed between the side end of the overlapping piece 2*b* and each lateral wall portion 1. The inner corner portions, not being continuous as described above, are neither projected nor rounded as in the case of the outer corner portion P (the conventional corner portion). Therefore, when the sheet staples 4 are loaded into the refill cartridge, there occurs no inconvenience of catching the corner portions 4*a* of the sheet staples 4 by the corner portions of the refill cartridge. Hence, the sheet staples 4 move downward always smoothly, which in turn implements reliable forwarding.

While the inside rear wall portion 2 is formed by folding the overlapping piece 2*b* in the above embodiment, the invention can be applied to a construction that the overlapping piece is formed as a separate piece from the rear wall piece so that the overlapping piece can be bonded to the rear wall piece while overlapped inside the rear wall piece.

Figure 6:
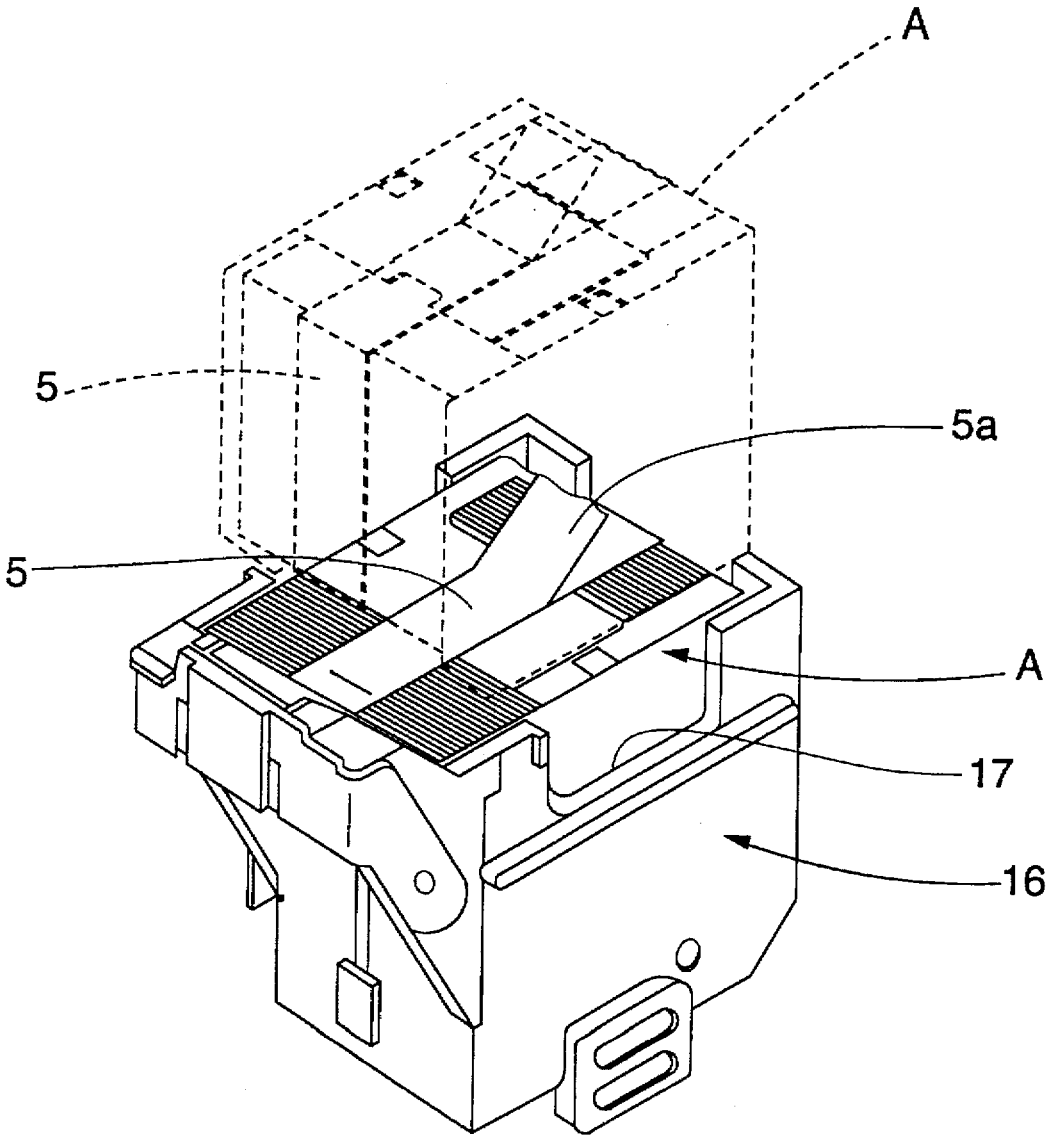
FIG. 6 is a perspective view showing a state in which the refill cartridge is loaded into a cartridge of an electric stapler.
Figure 7:
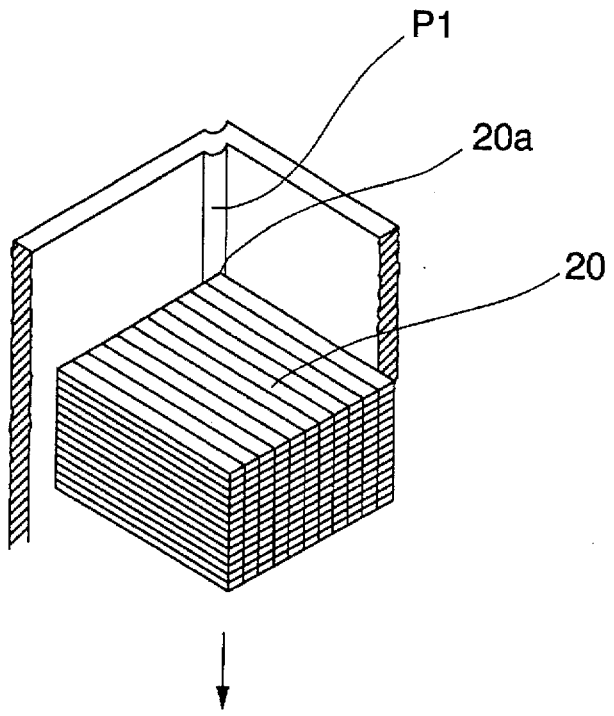
FIGS. 7(*a*) and 7(*b*) are perspective views showing a conventional refill cartridge.
Figure 7:
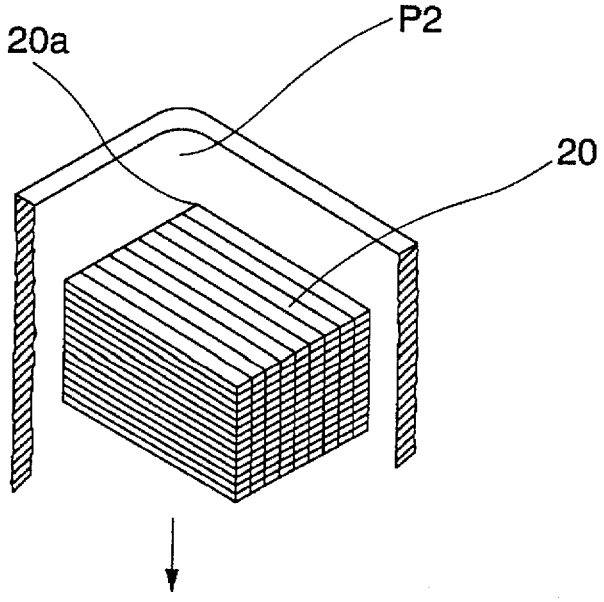

The thus constructed refill cartridge is accommodated in a cartridge 16 shown in FIG. 6. This cartridge 16 has an accommodating section 17 of a refill cartridge A and is releasably attached to the main body of an electric stapler. The electric stapler main body is not shown in the drawing.

The refill cartridge A is accommodated in the accommodating section 17 of the cartridge 16 in the following steps. The refill cartridge A is inserted into the accommodating section 17 with the binding tape 5 wound around the refill cartridge A. After the refill cartridge A has been accommodated, the biding tape 5 wound around the sheet staples 4 is first released at the bonded portion thereof by pulling a tab 5*a* thereof, and then completely removed by further pulling the tape 5 out in a single direction.

What is claimed is:

1. A staple refill cartridge for an electric stapler, said refill cartridge being releasably attached to the electric stapler via a cartridge and made of paper for accommodating sheet staples formed by uniting straight staples together in sheet form, said refill cartridge comprising:

two lateral wall portions;

a rear wall portion formed between said two lateral wall portions into a continuous body, corner folds being formed between opposite lateral edges of said rear wall portion and respective rear edges of each of said two lateral wall portions; and an overlapping piece having substantially the same size as said rear wall portion, said overlapping piece being overlapped inside said rear wall portion, wherein an inner surface of said overlapping piece is disposed inwardly of inner portions of said corner folds to prevent corner portions of the sheet staples accommodated by said refill cartridge from contacting said inner portions of said corner folds.

2. A staple refill cartridge according to claim 1, wherein said overlapping piece is formed with said continuous body.

3. A staple refill cartridge according to claim 1, wherein said overlapping piece is separate from said continuous body.

4. A staple refill cartridge according to claim 1, wherein a width of said overlapping piece is smaller than a width of said rear wall portion.

5. A staple refill cartridge according to claim 1, wherein each of said lateral wall portions includes a bottom piece attached to said lateral wall portion at a bottom edge thereof.

6. A staple refill cartridge according to claim 5, wherein a lower end of said overlapping piece is inserted into a gap formed between said lateral wall portions and said bottom pieces.

7. A staple refill cartridge according to claim 1, further comprising a binding tape wound around the sheet staples and the staple refill cartridge.

* * * * *